US006641106B2

(12) United States Patent
Beaty et al.

(10) Patent No.: US 6,641,106 B2
(45) Date of Patent: Nov. 4, 2003

(54) FORCE DISTRIBUTION MULTI-PIECE HINGED HANGER

(76) Inventors: Alan Keith Beaty, 1930 Chippington Dr., San Antonio, TX (US) 78253; Wallace Andrew Pennington, 6915 Wright Way St., San Antonio, TX (US) 78240

( * ) Notice: Subject to any disclaimer, the term of this patent is extended or adjusted under 35 U.S.C. 154(b) by 0 days.

(21) Appl. No.: 10/293,584

(22) Filed: Nov. 13, 2002

(65) Prior Publication Data

US 2003/0066941 A1 Apr. 10, 2003

Related U.S. Application Data

(63) Continuation-in-part of application No. 09/631,704, filed on Aug. 3, 2000.

(51) Int. Cl.[7] ..... A47G 1/16

(52) U.S. Cl. ..... 248/475.1; 248/216.4; 248/217.2; 248/497

(58) Field of Search ..... 248/216.1, 216.4, 248/217.1, 217.2, 217.3, 218.1, 218.3, 220.21, 220.22, 222.51, 225.11, 225.21, 304, 309.2, 475.1, 294.1, 546, 495, 497, 301; 40/745, 761; 411/457, 461, 466, 469, 470

(56) References Cited

U.S. PATENT DOCUMENTS

| | | | | |
|---|---|---|---|---|
| 299,155 A | | 5/1884 | McGill | 248/498 |
| 365,882 A | | 7/1887 | Taylor | 248/304 |
| 392,624 A | | 11/1888 | Miles | 248/218.1 |
| 1,115,800 A | | 11/1914 | Froberg | 248/489 |
| 1,210,610 A | | 1/1917 | Dehn | 248/489 |
| 1,248,363 A | | 11/1917 | Malcomson | 248/489 |
| 1,445,372 A | | 2/1923 | Wagner | 248/304 |
| 1,667,211 A | * | 4/1928 | Light | 248/216.4 |
| 1,802,934 A | | 4/1931 | Balch | 248/217.3 |
| 2,055,442 A | | 9/1936 | Jones | 52/489.1 |
| 2,066,814 A | | 1/1937 | Williams | 411/458 |

(List continued on next page.)

FOREIGN PATENT DOCUMENTS

| | | | |
|---|---|---|---|
| CH | 81408 | * 11/1918 | 248/218.1 |
| GB | 676903 | * 8/1952 | 248/497 |

*Primary Examiner*—Ramon O. Ramirez
*Assistant Examiner*—Jon Szumny
(74) *Attorney, Agent, or Firm*—Gunn, Lee & Hanor, P.C.; Michelle Evans

(57) ABSTRACT

A hanger having a front plate attached through a plate junction to a back plate. At the rear of back plate are lower pins that extend outward from back plate. Back plate has slots that hold lower pins. A hinge pin is provided that traverses the upper portion of plate junction and fits into a slot that traverses the top of back plate horizontally. Hinge pin is bent backward and downward at right angles to ensure vertical portions of hinge pin do not create a binding condition between the fabric-covered wall or furniture and the back plate. Vertical portions of hinge pin are used to initially pin the hanger into the applicable fabric-covered wall or furniture. Once the tips of hinge pin are inserted into the fabric of the fabric-covered wall or furniture, the rest of the hanger will rotate freely on the horizontal axis of hinge pin allowing the lower pins to penetrate the fabric exterior surface and the inner core material at an angle slightly less than 90 degrees. Attached at the upper portion of the front plate is a hook or prong that extends outward and slightly upward from the plate. Upper pins are present in a second embodiment.

11 Claims, 2 Drawing Sheets

U.S. PATENT DOCUMENTS

| | | | | | |
|---|---|---|---|---|---|
| 2,640,672 | A | | 6/1953 | Bedford, Jr. | 248/218.2 |
| 2,988,315 | A | | 6/1961 | Saxe | 248/220.21 |
| 3,216,680 | A | | 11/1965 | Mosante | 248/304 |
| 3,715,096 | A | | 2/1973 | Filbert | 248/220.22 |
| 3,966,157 | A | * | 6/1976 | Corral et al. | 248/217.3 |
| 4,300,745 | A | * | 11/1981 | Peterson | 248/546 |
| 4,362,249 | A | | 12/1982 | Thalenfeld | 211/59.1 |
| 4,422,608 | A | | 12/1983 | Hogg | 248/205.4 |
| 4,619,430 | A | | 10/1986 | Hogg | 248/467 |
| 4,664,350 | A | | 5/1987 | Dodds et al. | 248/303 |
| D317,858 | S | | 7/1991 | Hoskinson et al. | D81/370 |
| 5,029,788 | A | | 7/1991 | Hoskinson et al. | 24/377 |
| D322,388 | S | | 12/1991 | Hoskinson et al. | D8/370 |
| 5,112,177 | A | | 5/1992 | Chamings | 411/447 |
| 5,393,184 | A | | 2/1995 | Beeuwkes, III | 411/469 |
| 5,507,545 | A | | 4/1996 | Krysiak | 24/453 |
| 5,878,988 | A | | 3/1999 | Rakower | 248/497 |
| 5,967,476 | A | | 10/1999 | Chen | 248/222.14 |
| 6,036,149 | A | | 3/2000 | Del Pino | 248/216.1 |
| 6,126,126 | A | * | 10/2000 | McKiernan, Jr. | 248/217.3 |

* cited by examiner

FORCE DISTRIBUTION MULTI-PIECE HINGED HANGER

This is a continuation in part patent application of U.S. patent application Ser. No. 09/631,704 filed on Aug. 3, 2000.

BACKGROUND OF THE INVENTION

1. Field of the Invention

Applicant's invention relates to a hanging apparatus for attaching objects to fabric covered walls or furniture. More specifically, the present invention relates to a hanging apparatus used on modular office systems furniture, sofas, chairs, vehicle seats, and sun visors.

2. Background Information

Hanging objects, particularly picture frames, on fabric-covered walls or furniture is difficult with prior art hangers because existing hangers do not securely attach to both the fabric exterior surface and the inner core material of the wall or furniture. Additionally with the prior art, hanging forces are not dispersed into multiple angles of incidence to the wall or furniture, nor are they supported by multiple or dispersed penetration points into the wall or furniture. These dispersion problems with the prior art cause the prior art fabric-covered wall and furniture hangers to pull the fabric exterior surface away from the inner core material and/or cause a sagging condition in the fabric.

Picture hangers have formerly attained commercial success by fastening securely to the inner surface of a wall or object without unduly damaging its exterior surface. However, these devices developed to secure objects to soft wall surfaces do not mitigate the hazard of surface tearing because they may detach from a wall's inner core material and hang on the fabric exterior surface causing it to rip. Additionally these prior art hangers do not provide adequate support for heavier objects. All hanging object weight in the prior art is distributed solely onto the fabric exterior surface and the weight is centralized at only one or two penetration points. Accordingly, the weight bearing capacity of the prior art is low and the possibility of damaging the fabric exterior surface in the prior art is high.

Pins are also known in the prior art that can pierce fabric. These pins have a wire bend protruding from the fabric for hanging objects. Prior art also contains plastic plates with long wire pins that attach to the surface material of a fabric-covered wall with a hook molded onto the plastic. The prior art hooks are not applicable to plaques or pictures because they are too wide to insert into the hole drilled into the plaque or picture backing. U.S. Pat. No. 5,029,788 issued to Hoskinson, et al and U.S. Pat. No. 4,664,350 issued to Dobbs, et al are specifically designed to attach to the surface only with two or less entry points without hinges or levers to increase adhesion when weight on the hanger is increased. However, these prior art inventions still do not solve the problems that exist with attaching a hanging device to a fabric covered wall or furniture. The present invention; however, does solve these problems.

SUMMARY OF THE INVENTION

It is an object of the present invention to provide a novel hanger that can be attached to fabric-covered surfaces without pulling the fabric exterior surface away from the inner core material.

Still another object of the present invention is to provide a novel hanger that can be attached to fabric-covered surfaces without causing sagging.

Another object of the present invention is to provide a novel hanger that can be attached to fabric-covered surfaces without ripping the fabric exterior surface.

It is yet another object of the present invention to provide a novel hanger that binds to both the inner core material and the fabric exterior surface of fabric-covered surfaces.

Yet another object of the present invention is to provide a novel hanger having a front plate, back plate, lower (and in some embodiments, upper pins), hinge pins, and hook/prong.

Still another object of the present invention is to provide a novel hanger whereby the hanging forces are imparted mostly to the inner core material by piercing the inner core material in a perpendicular plane with hinge pins while lower pins are used to penetrate the fabric exterior surface and distribute force in another plane perpendicular to the first thereby preventing movement of the present hanger.

Another object of the present invention is to provide a novel hanger that creates more piercing force to the inner core material when more weight is added to the hook.

An additional object of the present invention is to provide a novel hanger that incorporates two upper pins that provide additional support through the fabric exterior surface.

It is another object of the present invention to provide a novel hanger having a flat exterior for display of advertising information.

It is yet another object of the present invention to provide a novel hanger designed to accommodate a variety of interchangeable attachment surfaces that can be mounted to a front plate.

Another object of the present invention is to provide a novel hanger that can be hung in multiples to increase the hanging capacity.

Still another object of the present invention is to provide a novel hanger that can be attached quickly and safely by first time users with little or no instruction.

An additional object of the present invention is to provide a novel hanger that has a front plate that can be easily grasped by the user for insertion into the applicable surface.

Yet another object of the present invention is to provide a novel hanger that has a back plate to which lower and upper pins attach, making it difficult for a downward force to pull any single pin downward and out of the applicable surface.

It is still another object of the present invention to provide a novel hanger that securely attaches to both the inner core material and fabric exterior surface while providing the maximum amount of protection to the fabric exterior surface.

In satisfaction of these and related objectives, Applicant's present invention provides for a front plate attached through a plate junction to a back plate. At the rear of back plate are upper and lower pins that extend outward from back plate. Back plate has slots that hold upper and lower pins. A hinge pin is provided that traverses the upper portion of plate junction and fits into a slot that crosses the top of back plate horizontally. Hinge pin is bent backward and downward at right angles to ensure the vertical portions of the hinge pin do not create a binding condition between the fabric-covered wall or furniture and the plate. Vertical portions of hinge pin are used to initially pin the present invention into the applicable fabric-covered wall or furniture. Once the tips of hinge pin are inserted into the fabric of the fabric-covered wall or furniture, the rest of the hanger will rotate freely on the horizontal axis of hinge pin allowing the upper and lower pins to penetrate the fabric exterior surface and the inner core material at an angle slightly less than 90 degrees.

Attached to the upper portion of the front of front plate is a hook or prong that extends outward and slightly upward from the plate. The hook or prong is used to attach objects to the present invention. The bottom of front plate is suitable for display of advertising information.

DETAILED DESCRIPTION OF THE PREFERRED EMBODIMENT

Figure 1:
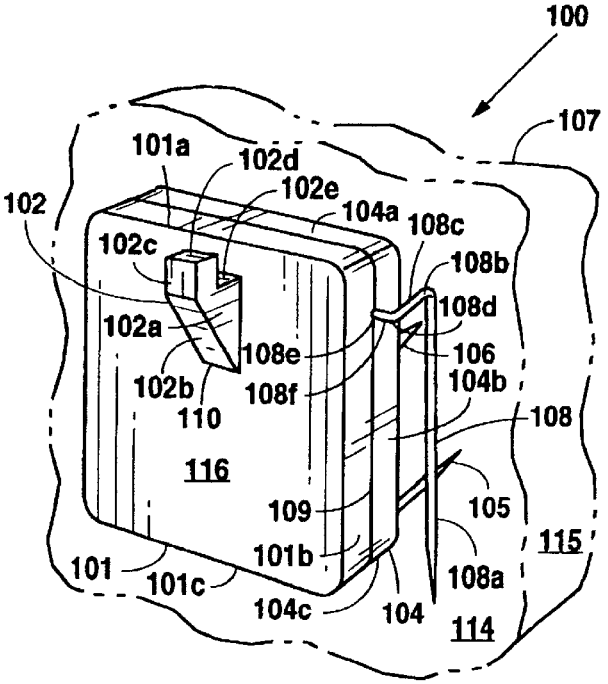
FIG. 1 is a perspective view of the preferred embodiment shown inserted into a fabric-covered wall, the embodiment having a hook.
Figure 2:
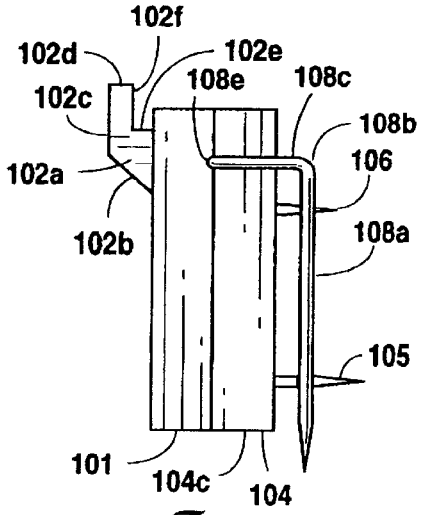
FIG. 2 is a side view of the preferred embodiment having a hook.
Figure 3:
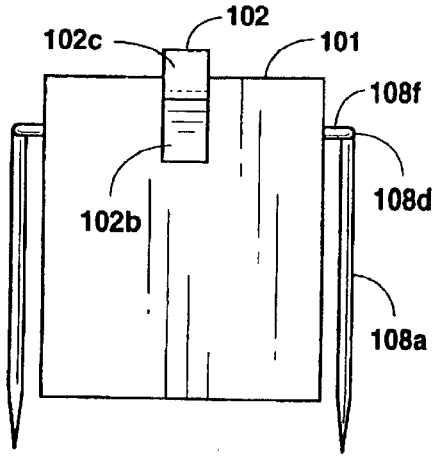
FIG. 3 is a front view of the preferred embodiment having a hook.
Figure 4:
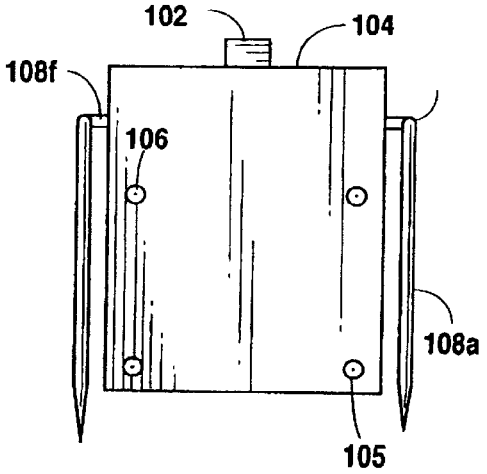
FIG. 4 is a back view of the preferred embodiment having a hook.

FIGS. 1 through 4 illustrate perspective, side, front and back views of the preferred embodiment of the present invention 100 shown inserted into a fabric-covered wall 107, the embodiment having a hook 102 attached to and extending from a generally rectangular front plate 101 at hook junction 110. The structure of hook 102 is formed from angled portion 102*b* at the lowermost portion of hook 102. Angled portion 102*b* continues into front portion 102*c* and front portion continues into top portion 102*d*. The functional portion of hook 102 is formed from lower L portion 102*f* and upper L portion 102*e*. Front plate 101 has top 101*a*, bottom 10*c*, and sides 101*b*. The bottom 116 of front plate 101 is suitable for display of advertising information.

Front plate 101 is attached to back plate 104 at plate junction 109. Back plate 104 is generally of the same dimensions as front plate 101, having top 104*a*, bottom 104*c*, and sides 104*b*. At the rear of back plate 104 are at least two upper pins 106 and at least two lower pins 105 that extend outward from back plate 104. Upper pins 106 are aligned one to the other as are lower pins 105. Upper pins 106 and lower pins 105 have a sharp point at one end and a flat head at the other; the flat head positioned through back plate 104 keeping upper pins 106 and lower pins 105 from falling through back plate 104. Upper pins 106 are comparatively shorter in length than lower pins 105 which ensures the upper pins 106 and lower pins 105 will contact the fabric at essentially the same time when rotated into position against the wall or furniture. Back plate 104 has slots (not shown) that hold the bases of upper pins 106 and lower pins 105.

A hinge pin 108 is provided that traverses the upper portion of plate junction 109 and fits into slot (not shown) that traverses the top of back plate 104 horizontally. Hinge pin 108 proceeds from slot (not shown) out from plate junction 109 at insertion end 108*e* into insertion portion 108*f*. Hinge pin 108 is bent backward at second elbow 108*d* into horizontal portion 108*c* and downward at right angles at first elbow 108*b* to ensure vertical portions 108*a* of the hinge pin 108 do not create a binding condition between the fabric-covered wall or furniture 108 and the back plate 104. Vertical portions 108*a* of hinge pin 108 are used to initially pin the present invention into the applicable fabric-covered wall or furniture 107. Once the tips of hinge pin 108 are inserted into the fabric of the fabric-covered wall or furniture 107, the rest of the hanger 100 will rotate freely on the horizontal axis of hinge pin 108 allowing the upper pins 106 and lower pins 105 to penetrate the fabric exterior surface 114 and the inner core material at an angle slightly less than 90 degrees.

Figure 5:
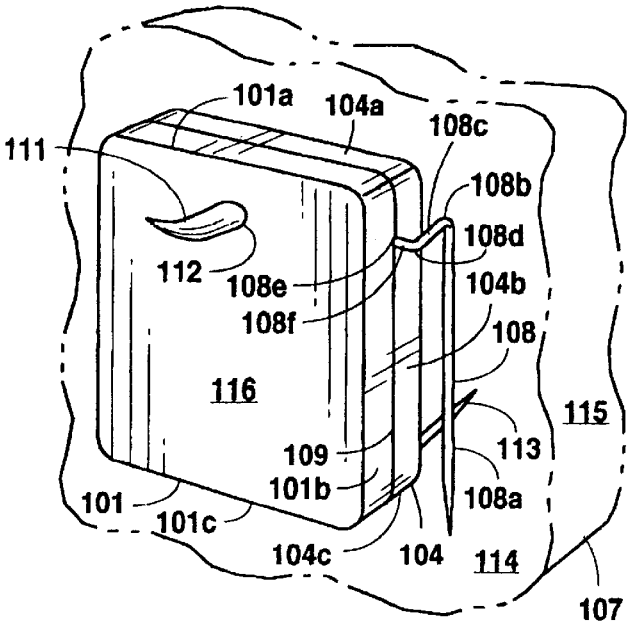
FIG. 5 is a perspective view of a second embodiment of the present invention shown inserted into a fabric-covered wall, the embodiment having a prong.
Figure 7:
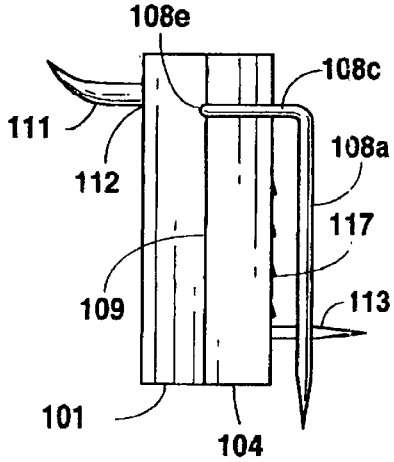
FIG. 7 is a side view of a second embodiment of the present invention having a prong.
Figure 6:
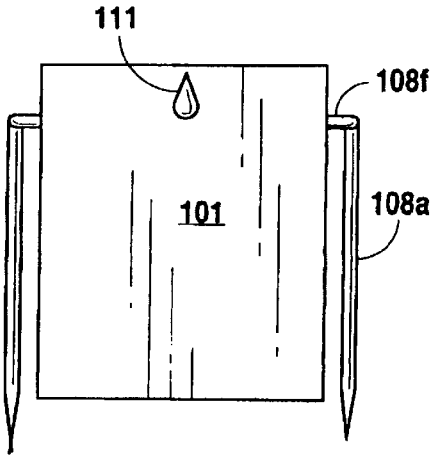
FIG. 6 is a front view of a second embodiment of the present invention having a prong.
Figure 8:
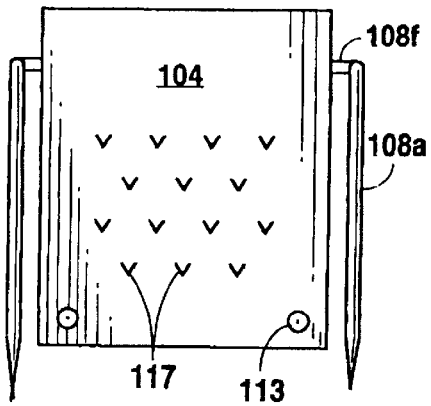
FIG. 8 is a back view of a second embodiment of the present invention having a prong.

FIGS. 5 through 8 illustrate a second embodiment of the present invention having a prong 111 attached to and extending from a generally rectangular front plate 101 at prong junction 112. Front plate 101 has top 101*a*, bottom 101*c* and sides 101*b*. The bottom 116 of front plate 101 is suitable for display of advertising information.

Front plate 101 is attached to back plate 104 at plate junction 109. Front plate 101 and back 104 are preferably constructed of high strength molded plastic. Back plate 104 is generally of the same dimensions as front plate 101, having top 104*a*, bottom 104*c*, and sides 104*b*. At the rear of back plate 104 are at least two lower pins 113 that extend outward from back plate 104. Lower pins 113 have a sharp point at one end and a flat head at the other, the flat head positioned through back plate 104 keeping lower pins 113 from falling through the back plate 104. Lower pins 113 are aligned one to the other. Back plate 104 has slots (not shown) that hold the bases of lower pins 113. On the surface of back plate 104 are small teeth 117 that aid in gripping the present invention to the appropriate fabric-covered surface.

A hinge pin 108 is provided that traverses the upper portion of plate junction 109 and fits into a slot (not shown) that traverses the top of back plate 104 horizontally. Hinge pin 108 proceeds from slot (not shown) out from plate junction 109 at insertion end 108*e* into insertion portion 108*f*. Hinge pin 108 is bent backward at second elbow 108*d* into horizontal portion 108*c* and downward at right angles at first elbow 108*b* to ensure the vertical portions 108*a* of the hinge pin 108 do not create a binding condition between the fabric-covered wall or furniture 107 and the back plate 104. Vertical portions 108*a* of hinge pin 108 are generally parallel and are used to initially pin the present invention into the applicable fabric-covered wall or furniture 107. Once the tips of hinge pin 108 are inserted into the fabric of the fabric-covered wall or furniture 107, the rest of the hanger 100 will rotate freely on the horizontal axis of hinge pin 108 allowing the lower pins 113 to penetrate the fabric exterior surface 114 and the inner core material 115 at an angle slightly less than 90 degrees.

The present hanger, either in its preferred or second embodiment, is attached to fabric-covered walls or furniture 107 by extending the vertical portions 108*a* of hinge pin 108 in a downward motion. Once this is accomplished, the hanger is then pivoted on the horizontal axis of the hinge pin 108 which brings the vertical portion 108*a* into contact with the surface of the fabric-covered wall or furniture 107. The thumb or palm of the user is then placed against the lower portion of front plate 101 and upper pins 106 and lower pins. 105 (or lower pins 113 where applicable) are pushed through the fabric exterior surface 114 and into the inner core material 115. Due to the design of the present hanger, when more weight is added to the hook 102 or prong 111, it is translated through the front plate 101 such that the upper pins 106 and lower pins 105 (or lower pins 113 where applicable) are forced further into the inner core material 115 of the fabric-covered wall or furniture 107. This process also presses the fabric exterior surface 114 into the inner core material 115 reducing the possibility that the fabric exterior surface 114 will rip or tear.

The hanger of the present invention is preferably approximately 1.38 inches (35 mm) tall, 1 inch (25 mm) wide, and 0.25 inches (6.25 mm) thick, excluding the length of lower pins 105 and upper pins 106 (and lower pins 113 where applicable). However, it will be understood by those skilled in the art that hangers can be constructed larger or smaller than these preferred dimensions and could contain a different number of lower pins 105 and upper pins 106 (and lower pins 113 where applicable) arranged in unique dispersion patterns to accommodate a range of hanging object weights, shapes and sizes.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. A force distributing hanger for a fabric-covered wall or furniture having a fabric exterior surface and an inner core material, said hanger comprising:

a first planar member overlapping a second planar member, each planar member having two faces, one face being an exposed face and the other face being an unexposed face, said overlapping being between said faces of said planar members to form an overlap junction;

a plurality of pins attached to and extending orthogonally from said exposed face of said second planar member;

a hinge pin that traverses said first planar member and said second planar member at said overlap junction, said hinge pin having a first horizontal portion perpendicular to two second horizontal portions, said second horizontal portions being contiguous with two vertical portions; and a hanging means attached to said exposed face of said first planar member, whereby when said hinge pin is inserted into said fabric-covered wall or furniture, said plurality of pins can penetrate said fabric exterior surface and said inner core material thereby allowing distribution of any weight that is placed on said hanging means and preventing ripping of said fabric exterior surface.

2. The force distributing hanger for a fabric-covered wall or furniture having a fabric exterior surface and an inner core material of claim 1 wherein said plurality of pins comprises at least two lower pins.

3. The force distributing hanger for a fabric-covered wall or furniture having a fabric exterior surface and an inner core material of claim 2 wherein said hanging means is selected from the group consisting of hooks and prongs.

4. The force distributing hanger for a fabric-covered wall or furniture having a fabric exterior surface and an inner core material of claim 3 further comprising a defined area on said exposed face of said first planar member to attach advertisements.

5. The force distributing hanger for a fabric-covered wall or furniture having a fabric exterior surface and an inner core material of claim 4 wherein said said first planar surface to attach advertisements.

6. The force distributing hanger for a fabric-covered wall or furniture having a fabric exterior surface and an inner core material of claim 5 wherein said hinge pin traverses said first planar member and said second planar member at said overlap junction by way of said first horizontal portion.

7. A force distributing hanger for a fabric-covered wall or furniture having a fabric exterior surface and an inner core material, said hanger comprising:

a first planar surface;

a second planar surface attached behind said first planar surface;

at least two lower pins attached to and extending from said second planar surface;

a hinge pin that traverses said second planar surface; and a hanging means attached to said first planar surface, wherein said hanging means is selected from the group consisting of hooks and prongs;

wherein said first and second planar surface each include an exposed and an unexposed face;

wherein each of said unexposed faces are attached at a junction;

whereby when said hinge pin is inserted into said fabric-covered wall or furniture, said at least two lower pins can penetrate said fabric exterior surface and said inner core material thereby allowing distribution of any weight that is placed on said hanging means and preventing ripping of said fabric exterior surface.

8. The force distributing hanger for a fabric-covered wall or furniture having a fabric exterior surface and an inner core material of claim 7 further comprising a defined area on said first planar surface to attach advertisements.

9. The force distributing hanger for a fabric-covered wall or furniture having a fabric exterior surface and an inner core material of claim 8 further comprising at least two upper pins.

10. The force distributing hanger for a fabric-covered wall or furniture having a fabric exterior surface and an inner core material of claim 9 wherein said hinge pin traverses said second planar surface at said junction.

11. The force distributing hanger for a fabric-covered wall or furniture having a fabric exterior surface and an inner core material of claim 10 wherein said hinge pin is bent backward and downward from said second planar surface.

* * * * *